United States Patent [19]

Mifune et al.

[11] Patent Number: 4,713,321

[45] Date of Patent: Dec. 15, 1987

[54] PROCESS FOR PREPARING SILVER HALIDE EMULSION UTILIZING A PHOTOGRAPHICALLY USEFUL ADDITIVE CAPABLE OF BEING DEACTIVATED AND A DEACTIVATING AGENT THEREFOR AND SILVER HALIDE PHOTOGRAPHIC MATERIAL PREPARED BY THE PROCESS

[75] Inventors: Hiroyuki Mifune; Tadao Shishido; Yoshiaki Suzuki, all of Kanagawa, Japan

[73] Assignee: Fuji Photo Film Co., Ltd., Kanagawa, Japan

[21] Appl. No.: 834,278

[22] PCT Filed: Jun. 14, 1985

[86] PCT No.: PCT/JP85/00335

§ 371 Date: Feb. 14, 1986

§ 102(e) Date: Feb. 14, 1986

[87] PCT Pub. No.: WO86/00150

PCT Pub. Date: Jan. 3, 1986

[30] Foreign Application Priority Data

Jun. 15, 1984 [JP] Japan ..... 59-122982

[51] Int. Cl.[4] ..... G03C 1/02; G03C 1/06

[52] U.S. Cl. ..... 430/569; 430/564; 430/570; 430/580; 430/581; 430/582; 430/599; 430/605; 430/935; 430/943

[58] Field of Search ..... 430/569, 570, 580, 581, 430/582, 599, 605, 935, 943, 564

[56] References Cited

U.S. PATENT DOCUMENTS

| | | | |
|---|---|---|---|
| 3,862,842 | 1/1975 | Bissonette | 430/564 X |
| 3,957,490 | 5/1976 | Libeer et al. | 430/569 |
| 4,062,684 | 12/1977 | Hara et al. | 430/943 X |
| 4,225,666 | 9/1980 | Locker et al. | 430/569 |
| 4,413,055 | 11/1983 | Weyde et al. | 430/943 X |

FOREIGN PATENT DOCUMENTS

| | | | |
|---|---|---|---|
| 0144990 | 6/1985 | European Pat. Off. | 430/569 |
| 0159045 | 10/1985 | European Pat. Off. | 430/569 |
| 0164759 | 12/1985 | European Pat. Off. | 430/569 |

*Primary Examiner*—John E. Kittle
*Assistant Examiner*—Mukund J. Shah
*Attorney, Agent, or Firm*—Sughrue, Mion, Zinn, Macpeak & Seas

[57] ABSTRACT

A process for preparing a silver halide photographic emulsion to be used for a photographic material is provided. Therein, additives such as dyes, sensitizers, auxiliary agents to be used upon gold sensitization, and so on are utilized within a period from at the silver halide grain forming time to just before the emulsion coating, and oxidizing agents are added at the time when the functions of the additives become substantially needless to result in conversion of the additives to those having no bad influences on photographic characteristics of the emulsion prepared, or to those having such chemical structures as to facilitate their removal with a washing treatment or the like.

Silver halide emulsions prepared by the described process are also disclosed.

11 Claims, No Drawings

PROCESS FOR PREPARING SILVER HALIDE EMULSION UTILIZING A PHOTOGRAPHICALLY USEFUL ADDITIVE CAPABLE OF BEING DEACTIVATED AND A DEACTIVATING AGENT THEREFOR AND SILVER HALIDE PHOTOGRAPHIC MATERIAL PREPARED BY THE PROCESS

TECHNICAL FIELD

The present invention relates to a process for preparing a silver halide emulsion and a silver halide photographic light-sensitive material prepared by employing the process. More specifically, the invention relates to a process for preparing a silver halide emulsion using a photographically useful additive capable of being deactivated and a deactivating agent therefor.

Deactivatable, photographically useful additives (which are referred to as an agent to be deactivated, hereinafter) which can be employed in this invention include sensitizers (particularly sulfur-containing sensitizers), auxiliary agents to be used upon gold sensitization, and so on.

BACKGROUND ART

In the preparation of silver halide photographic emulsions, various additives are often used to change or improve photographic properties.

For instance, when methine dyes are employed at the time of preparing silver halide grains, they can cause change of size or size distribution in silver halide grains prepared. Further, by preparing silver halide grains in the presence of these compounds, it becomes possible to prepare grains difficult to produce under normal conditions such as AgCl grains having a (111) face, AgClBr grains having a (111) face, AgCl grains having a (110) face, AgClBr grains having a (110) face, AgBr grains having a (110) face and AgBrI grains having a (110) face, or to form grains having a (111) face under pAg conditions which theoretically only permits production of grains having a (100) face and to create the reverse of the above-described situation. Various crystal forms also become possible by this technique such as sticks, spheres and tabular forms. Specific examples are described in, for example, Japanese Patent Publication No. 42737/80, West German Patent Application (OLS) No. 2,932,185, *Journal of Photographic Science,* Vol. 21, p. 39 (1973), U.S. patent application Nos. 4,225,666, 4,183,756 and 2,735,766 and Unexamined Published Japanese Patent Application No. 23932/82. Further, the preparation of silver halide grains in the presence of methine dyes results in a remarkable increase of adsorption strength of the dyes on the grains. But at the same time, even if the so-obtained emulsions show excellent properties in terms of fog, sensitivity and tone gradation, because of the difficulty of desorption of the thus-employed dyes, the emulsions cannot be spectrally sensitized with dyes of other wavelengths. (That is, emulsions prepared using ortho dyes cannot be used as emulsions for regular wavelengths or panchromatic wavelengths.)

Further, even if silver halide emulsions of good monodispersibility or unusual crystal habits can be prepared by using desensitizing dyes, spectral sensitization cannot be performed unless the desensitizing dyes may be removed.

The silver halide emulsion grains which are obtained by using dyes vary over a wide range, and as a result, the desired silver halide emulsion grains cannot always be obtained with dyes of the desired spectrally sensitized wavelengths.

Moreover, when silver halide grains are prepared in the presence of dyes, even if the obtained grains have good monodispersibility or regular forms, there are cases where fog easily occurs due to the employed dyes, or subsequent chemical sensitization is strongly inhibited or marked development inhibition may occur during development.

On the other hand, photographically useful additives such as sensitizers and auxiliary agents to be used at the time of gold sensitization fully exert their effects at the time of or after the addition thereof in the course of preparing silver halide photographic emulsions to discharge their functions of changes or improvements in photographic characteristics. Thereafter, however, such additives become useless in most cases, and when remain in the silver halide emulsions, some of them do more harm than good to the photographic characteristics, to make matters worse.

As described above, the above-described various problems can be eliminated by speedily removing photographically useful additives after they are used for the preparation of silver halide emulsions, thus rendering them inactive.

Further, it is extremely difficult to completely remove and render inactive compounds having adsorption to silver halides by means of the above-described washing.

In particular, additives which have strong adsorption and which have strong effects on the formation of silver halide grains could not be removed by any known means.

In the light of the above-described circumstances, it has been strongly demanded to develop a system by which photographically useful additives can be smoothly removed and rendered inactive after they are used for the preparation of silver halide emulsions.

DISCLOSURE OF INVENTION

An object of the present invention is to provide a novel process for preparing a silver halide emulsion by which the above-described problems confronting the use of compounds which can be adsorbed by silver halide grains or react therewith can be solved, and another object is to provide a photographic light-sensitive material containing a silver halide emulsion prepared using this novel process As a result of searching examination, it has now been found that in the process of preparing a silver halide emulsion using a photographically useful additive, which can be adsorbed by silver halide grains or react therewith, within a period from the silver halide grain-forming time to just before the emulsion coating, the above-described objects are attained by using an oxidizing agent, which can lower or extinguish the function of the additive, that is, its adsorptive function or its reactive function, by exerting a chemical action on the additive, at the time when the function becomes unnecessary from the practical point of view.

Also, it has been found that the above-described objects are attained by providing at least one layer containing a silver halide emulsion prepared using combination of a photographically useful additive therewith and an oxidizing agent of the kind which can lower or extinguish the function of the additive by exerting its action on the additive at the time when the adsorptive or reactive function of the additive becomes substantially needless.

That is, the present invention comprises using a photographically useful additive (referred to as an agent to be deactivated, hereinafter) in the precipitating step, or at the time of physical or chemical ripening to achieve, e.g., control of the crystal face, the grain size and so on upon silver halide grain formation, or to have influences on photographic characteristics (e.g., sensitivity, gradation, etc.) and, further, using an oxidizing agent at the time when these photographically useful functions become unnecessary or the photographically useful additive comes to have rather undesirable effects, far from being harmless, if remains in the silver halide emulsion, to achieve the lowering or extinguishing of the functions of the agent to be deactivated.

Although the idea of removing the additive to be used upon formation of silver halide grains and thereafter, to become needless, by carrying out a washing step has been proposed, the idea of extinguishing the function of the additive by newly adding an oxidizing agent at a particular time is quite new and cannot be found in conventional arts of making emulsions.

In accordance with the present invention, it becomes feasible to lower or extinguish the photographically useful functions of agents to be deactivated by using oxidizing agents at specific times, respectively, whereby a wide variety of remarkable effects come to be achieved.

For example, it is now possible to easily deactivate additives (agents to be deactivated) which could not be easily removed even by washing with water and to render them incapable of showing any photographically adverse effects. Also, by deactivation, the additives can be converted into a form which can be easily removed by washing with water.

For example, use of oxidizing agents makes it possible to reduce or eliminate incorporation of agents to be deactivated into chemical ripening, to thereby reduce or eliminate their effects during the chemical ripening step. Because the additives are not incorporated into the stage of development, adverse effects during development (e.g., development restraining effects) can be eliminated. It is also possible to prevent the agents to be deactivated from interfering with adsorption of various additives such as sensitizing dyes, antifoggants, stabilizers and sensitizers which are employed up to immediately before the coating of the emulsions.

Other advantages which can be obtained by using the present invention include (i) emulsions having hard contrast can be obtained without any loss of relative sensitivity, (ii) dissolution time can be shortened, (iii) sensitivity can be increased, and the like.

Exemplary dyes to be used in the present invention include methine dyes such as cyanine dyes, merocyanine dyes, complex cyanine dyes, complex merocyanine dyes, oxonol dyes, styryl dyes, hemicyanine dyes, hemioxonol dyes, merostyryl dyes, polymethine dyes containing streptocyanine and azapolymethine dyes wherein the methine group in the methine chain is substituted by a nitrogen atom.

Exemplary cyanine dyes include 2 basic heterocyclic nuclei bonded by methine condensation which are derived from quaternary salts such as quinolinium, pyridinium, isoquinolinium, 3H-indolium, benzo[e]indolium, oxazolium, oxazolinium, thiazolinium, thiazolium, selenazolium, selenazolinium, benzoxazolium, benzothiazolium, selenazolium, imidazolium, imidazolinium, benzimidazolium, naphthoxazolium, naphthothiazolium, naphthoselenazolium, naphthoimidazolium, dihydronaphthothiazolium, dihydronaphthoselenazolium, pyrylium, imidazopyrazinium, imidazo[4,5-b]quinoxalium, pyrrolidinium and indole nucleus and the like, and generally include cyanine dyes which are used for the purpose of effecting spectral sensitization or increasing stabilization (e.g., fog prevention) of silver halide emulsions.

Merocyanine dyes include those compounds formed by condensation by methine bond of basic nuclei which are used for cyanine dyes and acidic nuclei which are derived from barbituric acid, 2-thiobarbituric acid, rhodanine, hydantoin, 2-thiohydantoin, 2-pyrazoline-5-one, 2-ixooxazoline-5-one, indane-1,3-dione, cyclohexane-1,3-dione, 1,3-dioxane-4,6-dione, pyrazoline-3,5-dione, 2-thiooxazolidine-2,4-dione, pentane-2,4-dione, alkylsulfonylacetonitrile, arylsulfonylacetonitrile, malonic acid diester, malononitrile, iso-quinoline-4-one, chroman-2,4-dione, pyrazolo[5,1-b]quinazoline and the like.

The dyes to be used in accordance with the present invention are described in the following literature: F. M. Hamer, *The Chemistry of Heterocyclic Compounds,* Vol. 18, The Cyanine Dyes and Related Compounds, A. Weissberger ed., Interscience, New York, 1964; D. M. Sturmer, *The Chemistry of Heterocyclic Compounds,* Vol. 30, A. Weissberger and E. C. Taylor eds., John Wiley, New York, 1977, p. 441; *Research Disclosure* 17643, 23–24 (1978), West German Pat. No. 929,080, U.S. Pat. Nos. 2,231,658, 2,493,748, 2,503,776, 2,519,001, 2,912,329, 3,656,959, 3,672,897, 3,694,217, 4,025,349 and 4,046,572, British Pat. No. 1,242,588, Japanese Patent Publication Nos. 14030/69 and 24844/77, British Pat. Nos. 584,609 and 1,177,429, Unexamined Published Japanese patent Application Nos. 85130/73, 99620/74, 114420/74 and 108115/77, U.S. Pat. Nos. 2,274,782, 2,533,472, 2,956,879, 3,148,187, 3,177,078, 3,247,127, 3,540,887, 3,575,704, 3,653,905, 3,718,472, 4,071,312 and 4,070,352 and the like.

The methine dyes to be used in the present invention, which are added in the formation of grains and chemical sensitization and which are deactivated by deactivating agents such as oxidizing agents in subsequent steps, are termed "methine dyes" herein since they belong to the same group in terms of chemical structure. The methine dyes may be either colored or colorless. In other words, absorption of visible light is not an essential requirement; what is required of these dyes is to influence grain formation or chemical sensitization and to exert preferable effects on the sensitivity and stability of photographic materials. Thus, in some cases dyes which do not absorb visible light are more preferable in relation to the particular type of equipment used for the preparation of photographic materials.

In accordance with the present invention, when color carriers (agents to be deactivated) are used in the formation of silver halide grains (e.g., precipitation and physical ripening processes) or chemical sensitization, use of the oxidizing agents of the present invention makes it possible to deactivate the adsorption of the dyes to silver halides or to decompose the dyes. As a result, the above-described various defects can be eliminated.

In the present invention, the term "dyes" includes sensitizing dyes (spectral sensitizing dyes), dyes in an ordinary sense, desensitizing dyes and the like.

Among the dyes to be used in the present invention, cyanine dyes, merocyanine dyes and rhodacyanine dyes are preferred.

Examples of particularly preferred dyes to be used in the present invention include those of formulae (D-I), (D-II), (D-III) and (D-IV):

Formula (D-I)

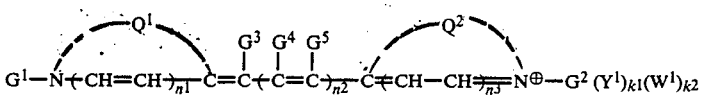

wherein $Q^1$ and $Q^2$ may be the same or different, and each represents a group of atoms which are required to form cyclic nuclei derived from basic heterocyclic compounds generally used for cyanine dyes such as oxazoline, oxazole, benzoxazole, naphthoxazole (e.g., naphtho[2,1-d]oxazole, naphtho[1,2-d]oxazole, naphtho-[2,3-d]oxazole), thiazoline, thiazole, benzothiazole, naphthothiazole (e.g., naphtho[1,2-d]thiazole, naphtho[2,1-d]thiazole and naphtho[2,3-d]thiazole), dihydronaphthothiazole (e.g., 8,9-dihydronaphtho[1,2-d]thiazole), selenazoline, selenazole, benzoselenazole, naphthoselenazole (e.g., naphtho[1,2-d]selenazole, and naphtho[2,1-d]selenazole), 3H-indole (e.g., 3,3-dimethyl-3H-indole), benzindole, imidazoline, imidazole, benzimidazole, naphthoimidazole (e.g., naphtho[1,2-d]-imidazole and naphzho[2,3-d]imidazole), pyridine, quinoline, imidazo[4,5-b]quinoxaline, pyrrolidine and the like. The above-illustrated nuclei may have one or two or more various substituents on the rings. Exemplary substituents include a hydroxy group, a halogen atom (e.g., fluorine, chlorine, bromine and iodine), an alkyl group or a substituted alkyl group (e.g., methyl, ethyl, propyl, isopropyl, butyl, cyclohexyl, octyl, decyl, octadecyl, 2-hydroxyethyl, 3-sulfopropyl, carboxymethyl, ethoxycarbonylmethyl, ethoxycarbonylmethyl, 2-cyanoethyl, trifluoromethyl, methoxymethyl, benzyl and phenethyl), an aryl group or a substituted aryl group (e.g., phenyl, 1-naphthyl, 2-naphthyl, 4-sulfophenyl, 3-carboxyphenyl, 4-biphenyl, tolyl, anisyl, 4-chlorophenyl, 2-thienyl, 2-furyl, 2-pyridyl and 4-pyridyl), an alkoxy group or a substituted alkoxy group (e.g., methyl, ethyl, isopropoxy, decyloxy and 2-methoxyethoxy), an aryloxy group (e.g., phenoxy, 1-naphthoxy, 4-methoxyphenoxy, 4-methylphenoxy and 3-chlorophenoxy), an alkylthio group (e.g., methylthio, ethylthio, butylthio and decylthio), an arylthio group (e.g., phenylthio, p-tolylthio, p-anisylthio and 2-naphthylthio), a methylenedioxy group, a cyano group, an alkenyl group or a substituted alkenyl group (e.g., vinyl, 1-butenyl and styryl), an amino group or a substituted aminc group (e.g., anilino, dimethylamino, diethylamino, morpholino, moncmethylamino, bis(hydroxyethyl)amino, acetamido, benzoylamido and methylsulfonylamino), a nitro group, a carboxy group, an alkoxycarbonyl group (e.g., methoxycarbonyl and erhoxycarbonyl), an acyl group (e.g., acetyl, benzoyl, propionyl, methylsulfinyl and methylsulfonyl), a sulfo group and the like.

$G^1$ and $G^2$ may be the same or different, and each represents an alkyl group, an aryl group and an alkenyl group, which may be either substituted or unsubstituted. Exemplary groups include methyl, ethyl, propyl, isopropyl, butyl, octyl, decyl, octadecyl, methoxyethyl, 2-ethoxyethyl, 2-hydroxyethyl, carboxymethyl, 2-carboxyethyl, 3-carboxypropyl, 2-sulfoethyl, 3-sulfopropyl, 3-sulfobutyl, 4-sulfobutyl, 4-sulfophenyl, 2-sulfatoethyl, 3-thiosulfatopropyl, 2-phosphonoethyl, chlorophenyl, allyl, 1-butenyl, 2,2,2-trifluoroethyl, 2,2,3,3-tetrafluoropropyl, phenethyl, 4-sulfophenethyl, 2-chloropropyl, 2-hydroxy-3-sulfopropyl, ethoxycarbonylmethyl and the like.

$G^3$ is a hydrogen atom or a fluorine atom, provided that when $n^2$ is not 0, $G^3$ represents an alkyl group or a substituted alkyl group (e.g., methyl, ethyl methoxyethyl) and that $G^3$ may form a 5- or 6-membered ring by cross-linking with $G^1$ via alkylene.

$G^4$ and $G^5$ are each a hydrogen atom, a substituted or unsubstituted lower alkyl group (e.g., methyl, ethyl, propyl, methoxyethyl, benzyl and phenethyl) and an aryl group (e.g., phenyl, anisyl and tolyl).

$n^1$ and $n^3$ are each 0 or 1, and $n^2$ is 0, 1, 2 or 3.

$Y^1$ is a cationic group; $W^1$ is an anionic group; $k^1$ and $k^2$ are each 0 or 1, which depends on the presence or absence of ionic substituents. $G^3$ and $G^5$, $G^4$ and $G^4$ (when $n^2$ is 2 or 3), $G^5$ and $G^5$ (when $n^2$ is 2 or 3) and $G^2$ and $G^5$ may, when taken together, respectively represent atoms which are required to complete alkylene cross-linking.

Formula (D-II)

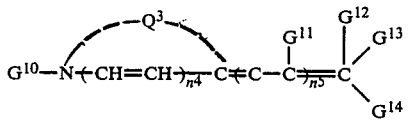

wherein $Q^3$ is the same as either $Q^1$ or $Q^2$ of formula (D-I); $G^{10}$ is the same as either $G^1$ or $G^2$ of formula (D-I); $G^{11}$ and $G^{12}$ are each a hydrogen atom, a substituted or unsubstituted lower alkyl group (e.g., methyl, ethyl, propyl, methoxyethyl, benzyl, phenethyl, 2-hydroxyethyl and 2-carboxyethyl), an aryl group (e.g., phenyl, naphthyl, 2-carboxyphenyl, tolyl and 4-chlorophenyl) and a halogen atom (e.g., fluorine and chlorine). Any two which are arbitrarily chosen from $G^{10}$, $G^{11}$ and $G^{12}$ may represent elements which are required to complete alkylene cross-linking.

$G^{13}$ and $G^{14}$ may be the same or different and each represents an electron attractive group. Examples of such groups include a cyano group, an alkyl or arylsulfonyl group (e.g., methylsulfonyl, phenylsulfonyl, tolylsulfonyl and octylsulfonyl), a carboxy group, an alkyl or arylcarbonyl group (e.g., acetyl, propionyl, decanoyl, benzoyl, tricarbonyl and 2-thienylcarbonyl), a 5- or 6-membered nitrogen-containing heterocyclic group (e.g., 2-thiazolyl, 2-benzothiazolyl, 2-benzimidazolyl, 2-pyridyl and 2-benzoselenazolyl). $G^{13}$ and $G^{14}$ may, when taken together, represent a group of atoms which are required to complete a cyclic acidic nucleus generally used for merocyanine dyes, oxonol dyes and hemicyanine dyes such as 2,4-oxazolidinedione (e.g., 3-ethyl-2,4-oxazolidinedione), 2,4-thiazolidinedione (e.g., 3-butyl-2,4-thiazolidinedione), 2-thio-2,4-oxazolidinedione (e.g., 3-phenyl-2-thio-2,4-oxazolidinedione), rhodanine (e.g., 3-ethylrhodanine, 3-carboxymethylrhodanine, 3-(2-sulfoethyl)rhodanine, 3-phenylrhodanine, 3-furfurylrhodanine, 3-(3-dimethylaminopropyl)rhodanine, 3-(2-ethoxyethyl)rhodanine and 3-benzylrhodanine), hydantoin (e.g., 1,3-diethylhydantoin), 2-thiohydantoin (e.g., 1,3-diethyl-2-thiohydantoin, 1-ethyl-3-phenyl-2-thiohydantoin, 1-(2-hydroxyethyl)-3-phenyl-2-thiohydantoin, 1-[2-(2-hydroxyethoxy)ethyl]-3-(2-pyridyl)-2-thiohydrantoin and 1-N-(2-hydroxyethyl-)aminocarbonylmethyl-3-phenyl-2-thiohydantoin), 2-pyrazoline-5-one (e.g., 3-methyl-1-phenyl-2-pyrazoline-5-one, 3-methyl-1-(4-carboxybutyl)-2-pyrazoline-5-one and 3-methyl-1-(4-sulfophenyl)-2-pyrazoline-5-one), 2-isooxazoline-5-one (e.g , 3-phenyl-2-isooxazoline-5-one), 3,5-pyrazolidinedione (e.g., 1,2-diphenyl-3,5-pyrazolidinedione), 1,3-indanedione, 1,3-dioxane-4,6-dione, 1,3-cyclohexanedione, pyrazolo[5,1-b]quinazoline, pyrazolo[5,1-b]quinazolone, barbituric acid (e.g., 1,3-diethylbarbituric acid) and 2-thiobarbituric acid (e.g., 1,3-diethylbarbituric acid and 1,3-bis(2-methoxyethyl)-2-thiobarbituric acid). $n^4$ is 0 or 1; and $n^5$ is 0, 1, 2 or 3.

boxypropyl, 2-sulfoethyl, 3-sulfopropyl, 4-sulfobutyl, 2-cyanoethyl, 2-carbamoylethyl, 2,2,2-trifluoroethyl, allyl, phenethyl, 4-sulfophenyl, 2-ethoxycarbonylmethyl, 2-pyridyl, 2-furyl, furfuryl, phenyl, 4-carboxyphenyl, tolyl, anisyl and the like. $n^6$ and $n^9$ are each 0 or 1; $n^7$ is 0, 1 or 2; $n^8$ is 0, 1 or 2; $Y^2$ is a cationic group; $W^2$ is an anionic group; $k^3$ and $k^4$ are each 0 or 1, which depends on the presence or absence of ionic substituents.

Formula (D-IV)

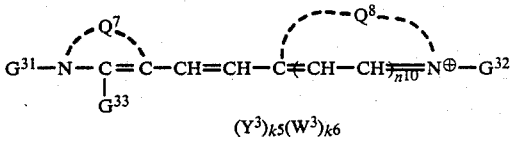

Formula (D-III)

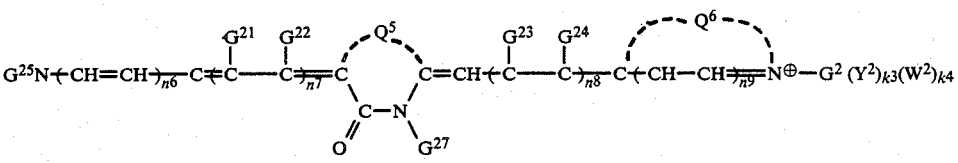

wherein $Q^4$ and $Q^6$ are each the same as either $Q^1$ or $Q^2$ of formula (D-I); $G^{21}$ and $G^{22}$ are each the same as either $G^{11}$ or $G^{12}$ of formula (D-II); $G^{23}$ and $G^{24}$ are each the same as either $G^4$ or $G^5$ of formula (D-I); and $G^{25}$ and $G^{26}$ are each the same as $G^1$ or $G^2$ of formula (D-I). $G^5$ represents elements required to complete a nitrogen-containing 5-membered ring. Examples of such nitrogen-containing 5-membered rings include 4-oxooxazolidine, 4-oxothiazolidine, 4-oxoimidazolidine and the like. $G^{25}$ and $G^{26}$ are each the same as either $G^1$ or $G^2$ of formula (D-I); $G^{27}$ is an alkyl group, an aryl group and an alkenyl group, which may be either substituted or unsubstituted. Examples of such groups include methyl, ethyl, propyl, isopropyl, butyl, octyl, decyl, octadecyl, methoxyethyl, 2-ethoxyethyl, 2-hydroxyethyl, carboxyethyl, 2-carboxyethyl, 3-carwherein $Q^7$ represents elements required to complete indole, pyrrolopyridine, pyrrolopyrimidine or pyrazolopyridine, provided that these compounds may have substituents on the heterocyclic nucleus. Examples of such substituents include nitro, cyano, trifluoromethyl, halogen, lower alkyl, lower alkoxy and the like. $Q^8$ is the same as either $Q^1$ or $Q^2$ of formula (D-I); $G^{33}$ is hydrogen, aryl (e.g., phenyl, p-nitrophenyl, p-cyanophenyl and tolyl), ethoxycarbonyl, methoxycarbonyl, halogen, lower alkyl, and lower alkoxy; $Y^3$ is a cationic group; $W^3$ is an anionic group; $k^5$ and $k^6$ are each 0 or 1; depending on the presence or absence of ionic substituents; and $n^{10}$ is 0 or 1.

Typical examples of the dyes to be used in the present invention are listed below:

D-1

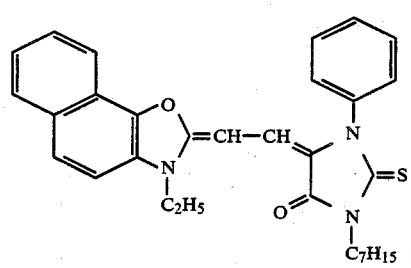

D-2

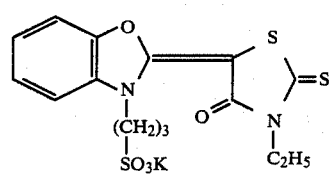

D-3

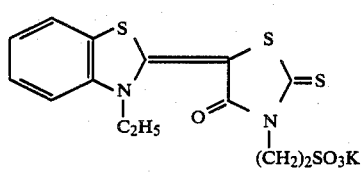

D-4

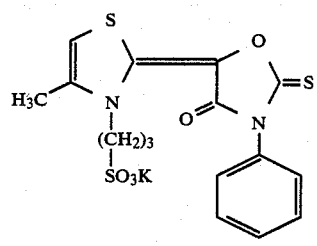

-continued
D-5
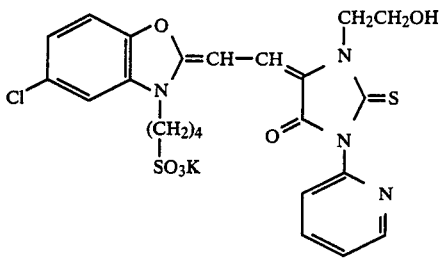
D-6
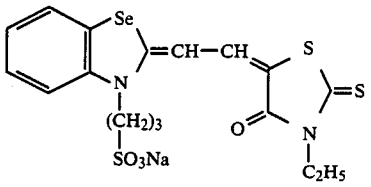
D-7
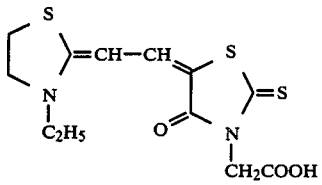
D-8
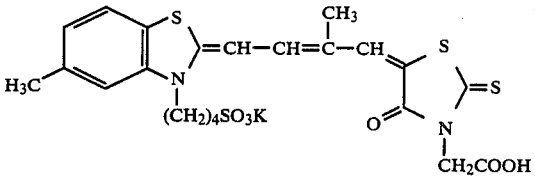
D-9
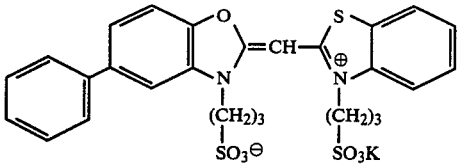
D-10
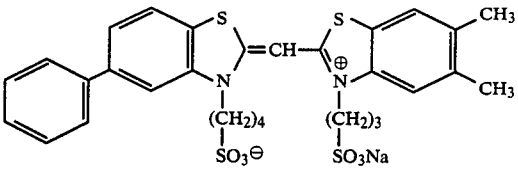
D-11
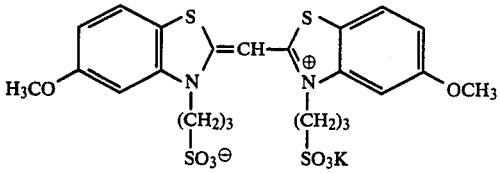
D-12
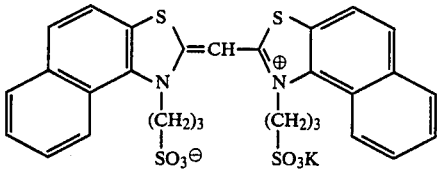
D-13
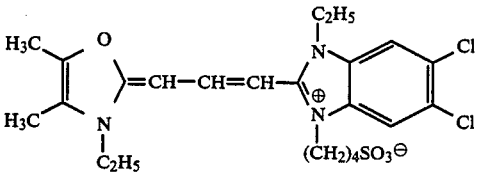
D-14
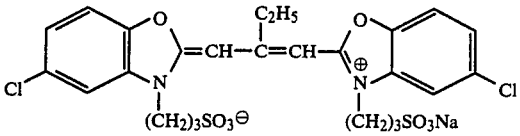
D-15
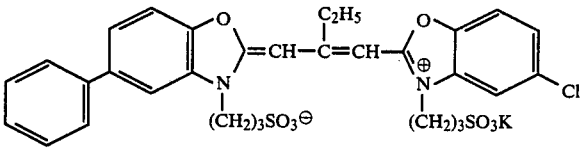
D-16
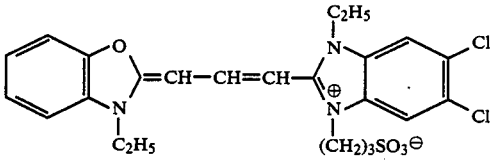
D-17
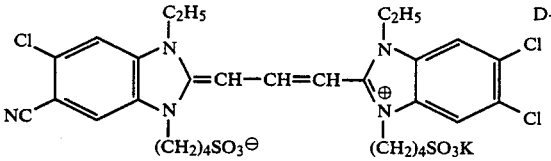
D-18
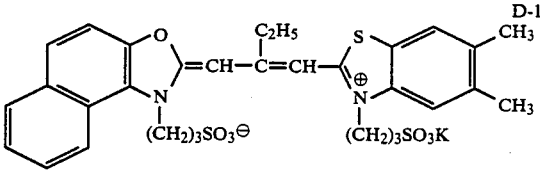
D-19
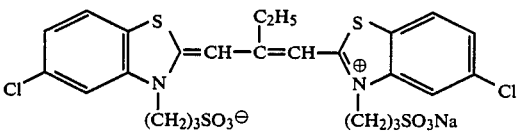

-continued
D-20
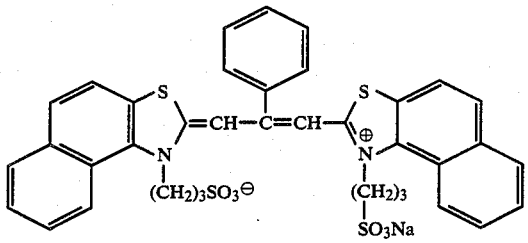
D-21
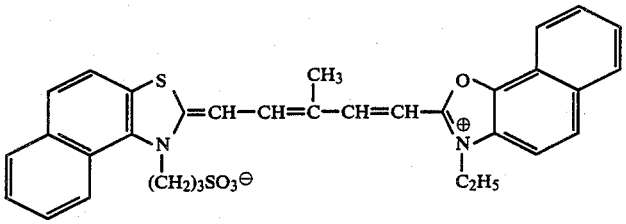
D-22
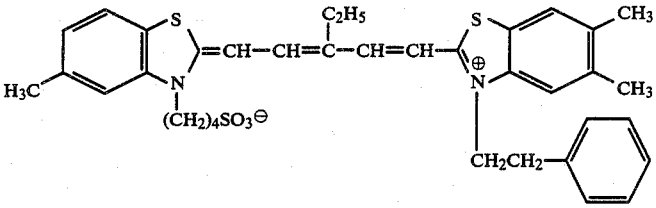
D-23
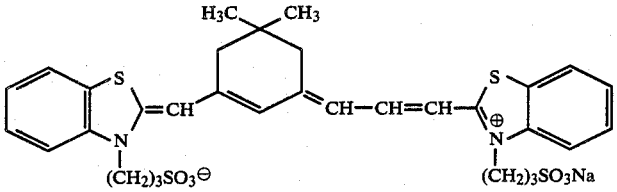
D-24
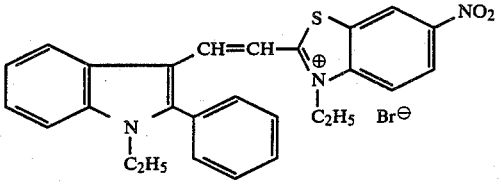
D-25
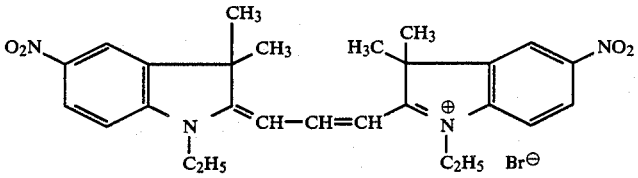
D-26
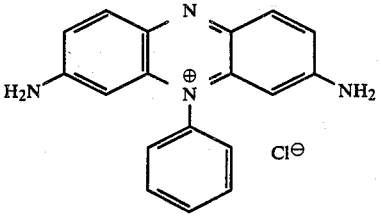
D-27
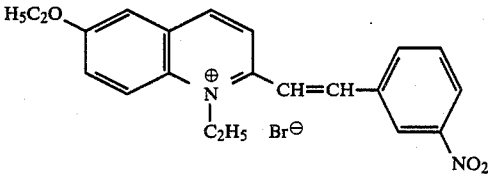

-continued

D-28

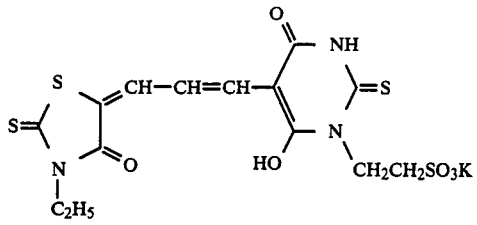

D-29

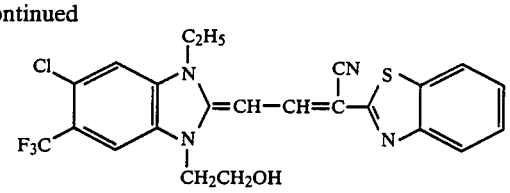

D-30

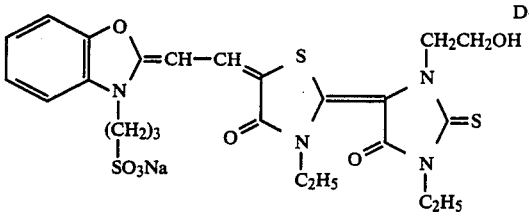

D-31

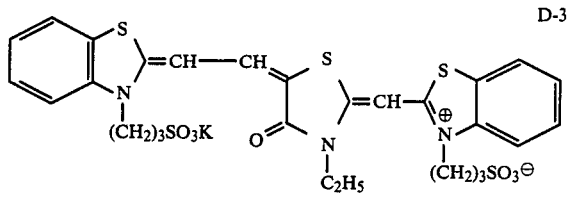

Exemplary sensitizers to be used in the present invention include sulfur-containing sensitizers such as thiosulfates (e.g., sodium thiosulfate, etc.), thioureas (e.g., allylthiourea, diphenylthiourea, triethylthiourea, etc.), rhodanines (e.g., 5-benzylidene-3-propylrhodanine, etc.) and the like. Specific examples are described in U.S. Pat. Nos. 1,574,944, 2,410,689, 2,278,947, 2,728,668 and 3,656,955, *Research Disclosure* (RD 17643), page 23, Item 3 (December, 1978), and the like.

Gold sensitization aids to be used in the present invention are compounds which may act as ligands of gold ions such as sulfur-containing sensitizers.

These gold sensitization aids, after being used in large quantities during the preparation of silver halide emulsions (e.g., chemical ripening and grain formation processes), can be deactivated by allowing oxidizing agents to act on them at any stage up to immediately before coating. By this deactivation, it is possible to stabilize photographic properties during dissolution or to increase stability of silver halide emulsions coated on supports during storage of photographic light-sensitive materials over a period of time.

Oxidizing agents, which are the vital point of the present invention, have the ability to act upon agents to be deactivated so as to lower or extinguish their photographically useful functions.

More specifically, compounds which are chemically inert towards the oxidation reduction potentials of the agents to be deactivated are employed effectively as oxidizing agents.

Useful oxidizing agents to be used in the present invention include inorganic oxidizing agents, organic oxidizing agents and the like.

Specific examples of oxidizing agents are shown below.

Inorganic oxidizing agents include oxyacid salts such as hydrogen peroxide (water), adducts of hydrogen peroxide (e.g., $NaBO_2.H_2O_2.3H_2O$, $2NaCO_3.3H_2O_2$, $Na_4P_2O_7.2H_2O_2$ and $2Na_2SO_4.H_2O_2.2H_2O$, etc.), peroxy acid salts (e.g., $K_2S_2O_8$, $K_2C_2O_6$ and $K_4P_2O_8$, etc.), peroxy complex compounds (e.g., $K_2[Ti(O_2)C_2O_4].3H_2O$, $4K_2SO_4.Ti(O_2)OH.SO_4.2H_2O$ and $Na_3[VO(O_2)(C_2C_4)_2.6H_2O$, etc.), permanganates (e.g., $KMnO_4$, etc.) and chromates (e.g., $K_2Cr_2O_7$, etc.).

The organic oxidizing agents include organic peroxides (e.g., peracetic acid and perbenzoic acid, etc.).

Further, oxidizing compounds such as oxidizing gases (e.g., ozone and oxygen gas, etc.), halogen releasing oxidizing compounds (e.g., sodium hypochlorite, N-bromosuccinimide and chloramine B (sodium benzenesulfonchloramide), chloramine T (sodium paratoluenesulfonchloramide), etc.) may also be employed.

Among the above-illustrated oxidizing agents, inorganic oxidizing agents and oxidizing gases are preferred, with inorganic oxidizing agents being particularly preferred. Among the inorganic oxidizing agents, hydrogen peroxide or adducts or precursors thereof are particularly preferred.

Most of these oxidizing agents are commercially available, and they can also be easily synthesized.

Preferred oxidizing agents to be used in the present invention are compounds which deactivate photographically useful functions of agents to be deactivated and which at the same time do not decompose gelatin or do not have strong desensitizing effects.

For example, when the agents to be deactivated are dyes, oxidizing agents applicable to the objects of the present invention can be most easily selected by checking whether they remove color when they are added to the dye solutions. Another requirement for the oxidizing agents to be used in the present invention is that they decompose dyes, while products of such decomposition or the oxidizing agents themselves do not exert any strongly adverse effects on the photographic properties.

Some dyes lose color and become desorbed even by simple acids (e.g., inorganic acids such as nitric acid, sulfuric acid and hydrochloric acid, and organic acids such as acetic acid), but these dyes need to be decomposed so that they will not regain color and be absorbed again after environmental changes (e.g., pH changes).

In accordance with the present invention, the oxidizing agents may be allowed to act in the presence of catalysts such as: metal salts such as tungsten salts (e.g., sodium tungstate and tungsten trioxide, etc.), vanadium salts (e.g., pervanadic acid and vanadium pentoxide, etc.), osmium salts (e.g., osmium tetroxide, etc.), molybdenum salts, manganese salts, iron salts and copper salts, etc.; selenium dioxide; and enzymes (e.g., catalase), etc. Among these catalysts, salts (containing oxides) of heavy metal and noble metal are preferable. These catalysts may be added prior to the addition of oxidizing agents or they may be employed at the time of the addition of oxidizing agents or thereafter. Since the action of oxidizing agents can be accelerated by these catalysts, deactivation (i.e., lowering or extinguishing of the functions) can be effected in the shorter time. The catalysts are usually used in amounts of about 10 mg to 1 g per mol of Ag.

In accordance with the present invention, oxidizing agents can be allowed to act in the presence of salts other than silver salts and halides. Exemplary salts include inorganic salts (e.g., nitrates such as potassium nitrate and ammonium nitrate, etc., sulfates such as potassium sulfate and sodium sulfate, etc., and phosphates, etc.) and organic salts (e.g., potassium acetate, sodium acetate and potassium citrate, etc.), and the like. These salts may be added to solutions of silver salts or halides beforehand. These salts are usually employed in amounts of about 1 to 20 g per mol of Ag.

Exemplary stabilizers to be used in the present invention include phosphoric acid, barbituric acid, uric acid, acetanilide, oxyquinoline, sodium pyrophosphate and sodium stannate, etc.

The amounts of addition of agents to be deactivated to be used in the present invention can be arbitrarily determined depending on the kinds of the agents to be deactivated, the time of addition, halogen composition of the silver halide grains, grain size and other factors, but preferred amounts are selected from the range of $10^{-8}$ to 1 mol per mol of silver halide, and the range of $10^{-7}$ to $10^{-1}$ mol per mol of silver halide is more preferred.

For example, when dyes are added as agents to be deactivated, they are added in amounts ranging from $10^{-8}$ to $10^{-2}$ mol per mol of silver halide, and more preferably from $10^{-7}$ to $10^{-3}$ mol per mol of silver halide.

The amounts of addition of the oxidizing agents to be used in the present invention can vary according to the kinds and amounts of the agents to be deactivated, the time of addition and other factors. In the case where it is necessary to completely eliminate the functions of agents to be deactivated, the oxidizing agents must be added in equimolar amounts or more with respect to the agents to be deactivated. On the other hand, in the case where the agents to be deactivated need to be deactivated to a specific extent, the amounts of addition are determined according to the particular purposes. Generally, oxidizing agents can be employed in amounts ranging from 1/100 to 3,000 molar times, based on the agents to be deactivated.

For example, when dyes are used as agents to be deactivated, oxidizing agents can be added in amounts ranging from 1/10 to 3,000 molar times, and preferably 1/5 to 1,000 molar times.

In accordance with the present invention, agents to be deactivated are typically employed during the period from the formation of silver halide grains to the completion of chemical ripening, and preferably employed during the period from the formation of silver halide grains to the commencement of chemical ripening.

In the case where the agents to be deactivated are dyes, they are preferably used from the formation of silver halide grains to the commencement of the washing process (particularly during the precipitation and physical ripening processes).

Further, in the case where agents to be deactivated are sensitizers and auxiliary agents to be used upon gold sensitization, they are preferably added in the chemical ripening process.

The agents to be deactivated as well as the oxidizing agents are added to silver halide emulsions in the form of solutions in water or organic solvents (e.g., alcohols, ethers, glycols, ketones, esters and amides, etc.). They can also be added in the form of powder dispersions in hydrophilic colloids such as gelatin.

Oxidizing agents can be added to the system either before or after addition of agents to be deactivated or both before and after, but are preferably added after addition of agents to be deactivated.

Addition of oxidizing agents can be performed at any stage from the formation of silver halide grains up to immediately before coating, but is basically effected after the photographically useful functions of agents to be deactivated have become no longer required. In the case where chemical ripening is carried out using chemical sensitizers, oxidizing agents are preferably added before the start of chemical ripening.

Preferred embodiments of using the oxidizing agents and agents to be deactivated will now be described below.

In the case where dyes are used as agents to be deactivated, the following procedures (1) to (3) may be employed:

(1) A silver halide emulsion having a specific crystal habit is formed by incorporating a dye during the formation of silver halide emulsion grains, and an oxidizing agent is allowed to act at some point during the period up to immediately before coating (preferably before the start of chemical ripening).

(2) A silver halide emulsion having high monodispersibility or a specific crystal habit is formed by growing silver halide emulsion grains in the presence of a dye during the formation of such grains, and an oxidizing agent is allowed to act at some point during the period up to immediately before coating (preferably before the start of chemical ripening).

(3) After allowing an oxidizing agent to act as in Procedure (1) or (2), a dye having different characteristics is added at some point during the period up to immediately before coating.

In the case where the agents to be deactivated are dyes, they are presumably decomposed by oxidation by the deactivating agents of the present invention, and as a result, their functions such as adsorption to silver halide grains are eliminated.

The agents to be deactivated of the present invention may be employed in a combination of two or more, as required. The oxidizing agents can also be employed in a combination of two or more as desired.

Further, when the oxidizing agents to be used in the present invention are added in large quantities, reducing substances which are substances having a reduction action to an oxidizing agent to be used in the present invention (e.g., sulfites, sulfinates and reducing sugars, etc.) are added at some appropriate stage to deactivate the residual excess oxidizing agents to avoid any adverse effects on subsequent chemical ripening, etc.

The amounts of the reducing substances to be added vary depending on the kinds of the oxidizing agents to be used and the desired degree of deactivation, but they are typically employed in equimolar amounts or more based on the oxidizing agents, and preferably in the range of 1 to 50 mols per mol of the oxidizing agents.

It has been conventionally known to use oxidizing agents in the preparation of silver halide emulsions. For example, in regard to heat developable light-sensitive materials, it is known to use halogen releasing oxidizing agents in the halogenation process to prepare silver halides from silver carboxylate. It is also known to add oxidizing agents in normal silver halide emulsions or the above-described heat developable light-sensitive materials for fog prevention. Examples of such methods are described in Japanese Patent Publication Nos. 40484/78 and 35488/79, Unexamined Published Japanese Patent Application Nos. 4821/77, 10724/74 and 45718/74. However, the purposes and advantages of using these oxidizing agents are completely different from those of the present invention.

The photographic emulsions of the present invention may incorporate any of silver bromide, silver iodobromide, silver iodochlorobromide, silver chlorobromide, silver iodide and silver chloride as a silver halide.

The grain size distribution may be either broad or narrow.

Silver halide grains in the photographic emulsions may have a regular crystal form such as a cube, an octahedron, a tetradecahedron, a rhombic dodecahedron, etc., an irregular crystal form such as a sphere, a plate, etc., or a composite form thereof. Silver halide grains may be a mixture of grains having various crystal forms.

Also, tabular grains having a diameter/thickness ratio of 3 or more, preferably from 5 to 20, may be employed. In this case, the tabular grains can be present in the emulsion in such a content as to form 50% or more of the whole grains, based on the projected area. Details of such grains are described in U.S. Pat. Nos. 4,434,226 and 4,439,520, European Pat. No. 84,637 A2, Gutoff, *Photographic Science and Engineering,* Vol. 14, pp. 248–257 (1970), and so on.

The silver halide grains may differ in phase between the inside thereof and the surface portion thereof or may be homogeneous.

Further, the silver halide grains may also include junction type silver halide crystals composed of an oxide crystal, e.g., PbO, and a silver halide crystal, e.g., silver chloride, epitaxially grown silver halide crystals (e.g., a silver bromide crystal on which silver chloride, silver iodobromide, silver iodide, etc., is epitaxially grown) and crystals of hexagonal or silver iodide on which hexahedral silver chloride is orientatedly overgrown.

The silver halide grains in the photographic emulsion can have an optional grain size distribution and may be a monodispersed. The term "monodispersed" herein means a dispersion system wherein more than 95% of the total silver halide grains are included in the size range within ±60%, preferably 40%, of the number mean grain size. The term "number mean grain size" herein used means the number mean diameter of the projected areas of the total silver halide grains.

The photographic emulsions according to the present invention can be prepared by the methods as described in P. Glafkides, *Chimie et Physique Photographique* (Paul Montel, 1967), G. F. Duffin, *Photographic Emulsion Chemistry* (The Focal Press, 1966), V. L. Zelikman et al., *Making and Coating Photographic Emulsion,* (The Focal Press, 1964), etc. That is, photographic emulsions can be prepared according to any of the acid process, the neutral process, the ammonia process, and the like. Methods for reacting a water-soluble silver salt with a water-soluble halide include a single jet method, a double jet method and a combination thereof.

In addition, a method in which silver halide grains are produced in the presence of excess silver ions (the reverse mixing method) can also be employed. Further, the controlled double jet method, in which the pAg of the liquid phase wherein silver halide grains are to be precipitated is maintained constant, may also be employed. According to this method, silver halide emulsions in which grains have a regular crystal form and an almost uniform size distribution can be obtained.

Two or more silver halide emulsions prepared separately may be used in the form of a mixture.

It is preferred that the silver halide emulsions to be used in the present invention are substantially of a surface latent image type.

The term "substantially of a surface latent image type" is defined that when the emulsion, after exposure to light for 1 to 1/100 sec, is developed by the processes of surface development (A) and internal development (B) as shown below, the sensitivity obtained by surface development (A) is larger than the sensitivity obtained by internal development (B). The term "sensitivity" as used herein is defined as follows:

$$S = 100/Eh$$

wherein S is sensitivity, and Eh is the exposure dose required to provide a density which is exactly halfway between the maximum density (Dmax) and the minimum density (Dmin): $\frac{1}{2}(Dmax + Dmin)$.

Surface Development (A)

A photographic emulsion is developed in a developer having the following composition at 20° C. for 10 min:

| | |
|---|---|
| N—Methyl-p-aminophenol (hemisulfate) | 2.5 g |
| Ascorbic Acid | 10 g |
| Sodium Metaborate.$4H_2O$ | 35 g |
| Potassium Bromide | 1 g |
| Water to make | 1 liter |

Internal Development (B)

A photographic emulsion is treated in a bleaching solution containing 3 g/l of red prussiate and 0.0125 g/l of phenosafranine at about 20° C. for 10 min, followed by washing with water for 10 min. The photographic emulsion is then developed in a developer having the following composition at 20° C. for 10 min:

| | |
|---|---|
| N—Methyl-p-aminophenol (hemisulfate) | 2.5 g |
| Ascorbic Acid | 10 g |
| Sodium Metaborate.$4H_2O$ | 35 g |
| Potassium Bromide | 1 g |
| Sodium Thiosulfate | 3 g |
| Water to make | 1 liter |

In the formation of silver halide grains or physical ripening of the grains, cadmium salts, zinc salts, lead salts, thallium salts, iridium salts or complexes thereof, rhodium salts or complexes thereof, iron salts or complexes thereof and the like may be present. The amount of these salts or complexes may be either small or large depending on the desired light-sensitive material.

Removal of soluble salts from the silver halide emulsion after the formation of silver halide grains or physical ripening can be effected by the noodle washing method comprising gelling the gelatin or a sedimentation method (or a flocculation method) using an inorganic salt, an anionic surface active agent, an anionic polymer (e.g., polystyrenesulfonic acid) or a gelatin derivative (e.g., acylated gelatin, carbamoylated gelatin, etc.).

The silver halide emulsion may or may not be chemically sensitized. Chemical sensitization can be carried out using processes as described in, for example, H. Frieser (ed.), *Die Grundlagen der Photographischen Prozesse mit Silberhalogeniden* (Akademische Verlagsgesellschaft, 1968), pp. 675–734.

More specifically, chemical sensitization can be carried out by sulfur sensitization using compounds containing sulfur capable of reacting with active gelatin or silver (e.g., thiosulfates, thioureas, mercapto compounds, rhodanines, etc.), reduction sensitization using reducing substances (e.g., stannous salts, amines, hydrazine derivatives, formamidinesulfinic acid, silane compounds, etc.), noble metal sensitization using noble metal compounds (e.g., gold complexes and complexes of Periodic Table Group VIII metals such as Pt, Ir, Pd, etc.).

Specific examples of sulfur sensitization are described in U.S. Pat. Nos. 1,574,944, 2,410,689, 2,278,947, 2,728,668 and 3,656,955, etc. Specific examples of reduction sensitization are described in U.S. Pat. Nos. 2,983,609, 2,419,974 and 4,054,458, etc. Specific examples of noble metal sensitization are given in U.S. Pat. Nos. 2,399,083 and 2,448,060, British Pat. No. 618,061, etc.

Photographic emulsions according to the present invention can contain various compounds for the purpose of preventing fog in preparation, storage or photographic processing, or for stabilizing photographic properties. Such compounds include azoles, such as benzothiazolium salts, nitroindazoles, triazoles, benzotriazoles, benzimidazoles (particularly nitro- or halogen-substituted ones); heterocyclic mercapto compounds, such as mercaptothiazoles, mercaptobenzothiazoles, mercaptobenzimidazoles, mercaptothiadiazoles, mercaptotetrazoles (particularly 1-phenyl-5-mercaptotetrazole) and mercaptopyrimidines; the above-described heterocyclic mercapto compounds having water-soluble groups such as a carboxyl group, a sulfonyl group or a like group; thioketo compounds, such as oxazolinethione; azaindenes, such as tetraazaindenes (particularly 4-hydroxy-substituted (1,3,3a,7)tetraazaindenes); benzenethiosulfonic acids; benzenesulfinic acids; and many other compounds known as antifoggants or stabilizers.

For details of these compounds, disclosure given in, for example, E. J. Birr, *Stabilization of Photographic Silver Halide Emulsions* (Focal Press, 1974) can be referred to.

Photographic emulsions of the light-sensitive materials of the present invention may be spectrally sensitized to blue light, green light or red light having relatively long wavelengths or infrared ray using sensitizing dyes. Sensitizing dyes which can be used for spectral sensitization include cyanine dyes, merocyanine dyes, complex cyanine dyes, complex merocyanine dyes, holopolar cyanine dyes, styryl dyes, hemicyanine dyes, oxonol dyes, hemioxonol dyes and the like. Specific examples of the spectral sensitizing dyes are described in, for example, P. Glafkides, *Chimie Photographique* (2nd Ed., 1957; Paul Montel, Paris), Chapters 35–41, F. M. Hamer, *The Cyanine and Related Compounds* (Interscience), U.S. Pat. Nos. 2,503,776, 3,459,553 and 3,177,210 and *Research Disclosure,* Vol. 176, 17643 (December, 1978), Item 23, IV–J.

The sensitizing dyes may be used either singly or in combination. In particular, combinations of sensitizing dyes are often used for the purpose of supersensitization. Typical examples of such combinations are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,769,301, 3,814,609, 3,837,862 and 4,026,707, British Pat. Nos. 1,344,281 and 1,507,803, Japanese Patent Publication Nos. 4936/68 and 12375/78 and Unexamined Published Japanese Patent Application Nos. 110618/77 and 109925/77.

In addition to sensitizing dyes, the photographic emulsions may incorporate dyes which do not have spectral sensitization effects in themselves or substances which do not substantially absorb visible light and which show supersensitization effects. Examples of such substances include aminostilbene compounds which are substituted with nitrogen-containing heterocyclic groups, such as those described in U.S. Pat. Nos. 2,933,390 and 3,635,721, condensation products of aromatic organic acid and formaldehyde such as those described in U.S. Pat. No. 3,743,510, cadmium salts, azaindene compounds and the like. The combinations as described in U.S. Pat. Nos. 3,615,613, 3,615,641, 3,617,295 and 3,635,721 are particularly useful.

Hydrophilic colloidal layers of the light-sensitive materials prepared by the present invention can contain water-soluble dyes as filter dyes or for various purposes including prevention of irradiation. Such dyes include oxonol dyes, hemioxonol dyes, styryl dyes, merocyanine dyes, cyanine dyes and azo dyes. Of these, oxonol dyes, hemioxonol dyes and merocyanine dyes are particularly useful.

Photographic emulsion layers and other hydrophilic colloidal layers of the photographic light-sensitive materials of the present invention may contain inorganic or organic hardeners. Examples of the hardeners which can be used include chromium salts (e.g., chromium alum, chromium acetate, etc.), aldehydes (e.g., formaldehyde, glyoxal, glutaraldehyde, etc.), N-methylol compounds (e.g., dimethylolurea, methyloldimethylhydantoin, etc.), dioxane derivatives (e.g., 2,3-dihydroxydioxane, etc.), active vinyl compounds (e.g., 1,3,5-triacryloyl-hexahydro-s-triazine, 1,3-vinylsulfonyl-2-propanol, etc.), active halogen compounds (e.g., 2,4-dichloro-6-hydroxy-s-triazine, etc.), mucohalogenic acids (e.g., mucochloric acid, mucophenoxychloric acid, etc.) and the like. These hardeners can be used alone or as a combination of two or more of them.

Photographic emulsion layers or other hydrophilic colloidal layers of the light-sensitive materials according to the present invention may contain various surface active agents for a wide variety of purposes, such as for assistance of coating, prevention of static charge, improvement of sliding properties, assistance of emulsion dispersing, prevention of adhesion, improvement of photographic properties (e.g., acceleration of development, increase in contrast and sensitivity, etc.) and the like.

Examples of surface active agents which can be used include nonionic surface active agents, such as saponin (steroid type), alkylene oxide derivatives (e.g., polyethylene glycol, polyethylene glycol/polypropylene glycol condensates, polyethylene glycol alkyl ethers or polyethylene glycol alkylaryl ethers, polyethylene glycol esters, polyethylene glycol sorbitan esters, polyalkylene glycol alkylamines or amides, polyethylene oxide adducts of silicone, etc.), glycidol derivatives (e.g., alkenylsuccinic polyglycerides, alkylphenol polyglycerides, etc.), fatty acid esters of polyhydric alcohols, alkyl esters of sugars, etc.; anionic surface active agents containing acidic groups, e.g., a carboxyl group, a sulfo group, a phospho group, a sulfuric ester group, a phosphoric ester group, etc., such as alkylcarboxylates, alkylsulfonates, alkylbenzenesulfonates, alkylnaphthalenesulfonates, alkylsulfates, alkylphosphates, N-acyl-N-alkyltaurines, sulfosuccinates, sulfoalkylpolyoxyethylene alkyl phenyl ethers, polyoxyethylene alkylphosphates, etc.; amphoteric surface active agents, such as amino acids, aminoalkylsulfonic acids, aminoalkyl sulfates or phosphates, alkylbetaines, amine oxides, etc.; and cationic surface active agents, such as alkylamine salts, aliphatic or aromatic quaternary ammonium salts, heterocyclic quaternary ammonium salts, e.g., pyridinium imidazolium, etc., aliphatic or heterocyclic phosphonium or sulfonium salts, and the like.

Photographic emulsion layers of the photographic light-sensitive materials according to the present invention may contain, for example, polyalkylene oxides or derivatives thereof (e.g., ethers, esters, amines, etc.), thioether compounds, thiomorpholines, quaternary ammonium salt compounds, urethane derivatives, urea derivatives, imidazole derivatives, 3-pyrazolidones and the like for the purpose of increasing sensitivity or contrast or accelerating development. Specific examples of such compounds are disclosed in, for example, U.S. Pat. Nos. 2,400,532, 2,423,549, 2,716,062, 3,617,280, 3,772,021 and 3,808,003 and British Pat. No. 1,488,991, etc.

Binders or protective colloids which can be used in emulsion layers or intermediate layers of the photographic light-sensitive materials of the present invention include gelatin to advantage, but other hydrophilic colloids can also be employed.

For example, usable hydrophilic colloids include proteins, such as gelatin derivatives, graft polymers of gelatin and other high polymers, albumin, casein, etc.; cellulose derivatives, such as hydroxyethyl cellulose, carboxymethyl cellulose, cellulose sulfates, etc.; sugar derivatives such as sodium alginate, starch derivatives, etc.; and a wide variety of synthetic hydrophilic high molecular weight polymers, such as polyvinyl alcohol, partially acetylated polyvinyl alcohol, poly-N-vinylpyrrolidone, polyacrylic acid, polymethacrylic acid, polyacrylamide, polyvinylimidazole, polyvinylpyrazole, etc., and copolymers containing comonomers which constitute the above-described polymers.

Photographic emulsion layers of the photographic light-sensitive materials according to the present invention can contain color forming couplers, i.e., compounds capable of forming color by oxidative coupling with aromatic primary amine developers (e.g., phenylenediamine derivatives, aminophenol derivatives, etc.) in color development processing. For example, such color forming couplers include magenta couplers, such as 5-pyrazolone couplers, pyrazolobenzimidazole couplers, cyanoacetylcumarone couplers, open chain acylacetonitrile couplers, etc.; yellow couplers, such as acylacetamide couplers (e.g., benzoylacetanilides, pivaloylacetanilides, etc.), etc.; and cyan couplers, such as naphthol couplers, phenol couplers, etc. It is preferable that these couplers have hydrophobic groups called ballast groups in their molecule and are thereby rendered nondiffusible. The couplers may be either 4-equivalent or 2-equivalent with respect to silver ions. Moreover, they may be colored couplers having a color correcting effect or couplers capable of releasing development restrainers with the progress of development (DIR couplers).

In addition to the DIR couplers, colorless DIR coupling compounds which yield colorless products upon coupling and release development restrainers may also be used.

The light-sensitive materials prepared in accordance with the present invention may contain hydroquinone derivatives, aminophenol derivatives, gallic acid derivatives, ascorbic acid derivatives, etc., as color fog preventing agents.

Hydrophilic colloidal layers of the light-sensitive materials prepared in accordance with the present invention may contain ultraviolet absorbents. Examples of ultraviolet absorbents which can be used include, for example, benzotriazole compounds substituted with aryl groups (as described in U.S. Pat. No. 3,533,794); 4-thiazolidone compounds (as described in U.S. Pat. Nos. 3,314,794 and 3,352,681); benzophenone compounds (as described in Unexamined Published Japanese Patent Application No. 2784/71); cinnamic acid esters (as described in U.S. Pat. Nos. 3,705,805 and 3,707,375); butadiene compounds (as described in U.S. Pat. No. 4,045,229); benzoxidole compounds (as described in U.S. Pat. No. 3,700,455) and the compounds as described in U.S. Pat. No. 3,499,762 and Unexamined Published Japanese Patent Application No. 48535/79. Ultraviolet absorbing couplers (e.g., α-naphthol type cyan forming couplers) or ultraviolet absorbing polymers may also be used. These ultraviolet absorbents may be mordanted in a specific layers.

In carrying out the present invention, the following known fading preventing agents can be used in combination. Further, color image stabilizing agents can be used individually or as a combination of two or more thereof. Examples of known fading preventing agents include hydroquinone derivatives, gallic acid derivatives, p-alkoxyphenols, p-oxyphenol derivatives, bisphenols, etc.

Silver halide photographic emulsions according to the present invention can further contain other various additives, such as whiteness increasing agents, desensitizing agents, plasticizers, lubricants, matting agents, oils, mordants and the like.

Specific examples of these additives are given in *Research Disclosure* No. 176, pp. 22–31 (RD-17643), (December, 1978), etc.

Photographic emulsions prepared by the present invention can be used in various color and black-and-white silver halide light-sensitive materials, such as color positive materials, color papers, color negative materials, color reversal materials (the emulsion to be used may or may not contain couplers), photographic light-sensitive materials for a photomechanical process (e.g., lith films), light-sensitive materials for CRT (Cathode Ray Tube) display, light-sensitive materials for X-ray recording (particularly, screen type films and non-screen type films), printout materials and heat developable light-sensitive materials. The emulsions according to the present invention can also be employed in a colloid transfer process, a silver salt diffusion transfer process, a dye transfer process, a silver dye bleaching process, etc.

Exposure for obtaining a photographic image can be carried out in a conventional manner. For example, any of various known light sources (including infrared rays), such as natural light (sunlight), a tungsten lamp, a fluorescent lamp, a mercury lamp, a xenon arc lamp, a carbon arc lamp, a xenon flash lamp, a cathode ray tube flying spot, a light-emitting diode, laser beams (e.g., a gas laser, YAG laser, dye laser, semiconductor laser, etc.) and the like can be used. The exposure may also be effected using light emitted from fluorescent substances excited by electron beams, X-rays, $\gamma$-rays, $\alpha$-rays, etc. Suitable exposure times which can be used include not only exposure times commonly used in cameras ranging from about 1/1,000 to about 1 sec, but also exposure times shorter than 1/1,000 sec, e.g., about $1/10^4$ to about $1/10^6$ sec as with xenon flash lamps or cathode ray tubes. Exposure times longer than 1 sec can also be used. The spectral composition of the light employed for exposure can be controlled using color filters, if desired.

Photographic processing of the light-sensitive materials according to the present invention can be carried out by known methods with known processing solutions as described in, for example, *Research Disclosure*, No. 176, pp. 28–30 (RD-17643). Any photographic processing, whether for the formation of silver images (black-and-white photographic processing) or for the formation of dye images (color photographic processing), can be employed according to the end use of the light-sensitive material. Processing temperatures are generally selected from the range of from 18° C. to 50° C., but temperatures lower than 18° C. or higher than 50° C. may also be used.

In some cases, other known developing methods, such as heat development, can be employed.

BEST MODE FOR CARRYING OUT THE INVENTION

The present invention will now be illustrated in greater detail with reference to the typical examples.

EXAMPLE 1

To an aqueous 2.8% gelatin solution (1 liter) containing 0.1 mol of sodium chloride and 2.3 mmol of 3,6-dithia-1,8-octanediol, which was kept at 60° C. with stirring, were added 750 ml of 1.8M silver nitrate solution and a mixed solution of an aqueous 2.0M sodium chloride solution and 0.46M potassium bromide over a period of 50 min by the double jet method while controlling the pAg level. 2 Minutes after the addition of the silver nitrate solution and the aqueous sodium chloride solution was started, addition of 100 ml of 2.0 mM solution of 5-[2-(3-ethylnaphtho[2,1-d]oxazoline-2-ylidene)vinylidene]-3-heptyl-1-phenyl-2-thiohydantoin (D-1) was simultaneously started. Then, 120 ml of aqueous 3% hydrogen peroxide solution was added and the resulting solution was stirred at 70° C. for 20 min. The resulting emulsion was washed with water and desalted, followed by sulfur sensitization with sodium thiosulfate. The so-obtained silver chloride emulsion grains were rectangular crystals having a mean diameter of 1.0 $\mu$m and a (100) face. (Emulsion A).

Then, a similar silver chloride emulsion was obtained for comparative purposes in a manner similar to the above process except that the aqueous hydrogen peroxide was not employed. The obtained emulsion was subjected to sulfur sensitization similar to the above. (Emulsion B).

To each of the thus-obtained Emulsions A and B, the following agents were sequentially added and the resulting emulsion was coated on a cellulose acetate film and dried to obtain Samples 51 and 52:

Stabilizer: 4-Hydroxy-6-methyl-1,3,3a,7-tetraazaindene
Hardener: Sodium 2,4-dichloro-6-hydroxy-s-triazine
Coating Aid: Sodium dodecylbenzenesulfonate The so-obtained samples were each exposed to light through an optical wedge through a separation filter (Eastman Kodak Wratten Filter 36B for blue light; Fiji Film Filter BPB-55 for green light; and Fuji Film Filter SC-60 for red light). The exposed samples were developed with Eastman Kodak D-72 Developer at 20° C. for 4 min, followed by normal stopping, fixing, washing and drying procedures.

As a result, it was found that Sample 52 (Emulsion B) had green sensitivity, while Sample 51 (Emulsion A) had no green sensitivity, showing that the dye had been completely decomposed and removed.

Both Emulsions A and B had approximately the same sensitivity to blue light, and decrease in sensitivity due to the oxidative decomposition by the deactivating agent of the present invention was not seen.

Then, a red sensitizing dye, (5,5'-dichloro-9-ethyl-3,3'-di(sulfopropyl)thiacarbocyanine.sodium salt (D-19)), was added to each of Emulsions A and B. To the resulting mixtures were added the above-described stabilizer, hardener and coating aid and the obtained emulsions were coated on cellulose acetate films to obtain Samples 53 and 54. These samples were exposed to light through an optical wedge through a separation filter, followed by development processing in a similar manner to the above.

As a result, it was found that Sample 53 (Emulsion A) had sufficient sensitivity to red light, while Sample 54 (Emulsion B) had reduced sensitivity, because the dye employed in the grain formation was still present therein, thus preventing the adsorption of the red sensitizing dye.

As described above, the present invention has made it possible to remove the dye employed in the grain formation by using the deactivating agent of the present invention without causing deterioration of photographic properties. As a result, it has become possible to freely prepare, as required, a silver halide emulsion which has sensitivity to wavelengths different from those of the dye employed in the grain formation.

EXAMPLE 2

To 1 liter of aqueous 2% gelatin solution containing 2.1 mmol of potassium bromide which was kept at 60° C. with stirring were added 16.7 ml of 1.18M silver nitrate solution and 11.7 ml of a mixed solution of 1.26M potassium bromide and 1.28M sodium chloride by the double jet method at a constant rate over 20 sec. The stirring was continued for further 3 min 40 sec, during which period 63 mmol of ammonium nitrate and 0.15 mol of ammonia were added. Then, 1 liter of 1.18M silver nitrate solution and a mixed solution of potassium bromide and sodium chloride having the same concentration as above were added by the double jet method over 50 min, while keeping the electric potential of the reaction mixture at −30 mV (silver-saturated calomel electrode). One minute after the recommencement of the addition of the silver nitrate solution and the mixed solution of potassium bromide and sodium chloride, simultaneous addition of 400 ml of a methanol solution of 1 mM sodium 3-[5-chloro-2-{2-[5-chloro-3-(3-sulfonatopropyl)benzoxazoline-2-ylidenemethyl]-1-butenyl}-3-benzoxazolio]-propanesulfonate (D-14) was started at a constant rate over 48 min. Then, 200 ml aqueous 3% hydrogen peroxide was added and the resulting mixture was stirred for 20 min. After washing and desalting, the resulting emulsion was subjected to gold-sulfur sensitization using sodium thiosulfate, chloroauric acid and potassium thiocyanate. The so-obtained emulsion had a mean grain diameter of 0.82 μm and was a highly monodispersed emulsion comprising grains of a (111) face only. (Emulsion C).

Emulsion D was obtained in a manner similar to Emulsion C, except that 180 mmol of potassium persulfate was used instead of hydrogen peroxide.

Next, Comparative Emulsion E was prepared in a manner similar to Emulsion C except that neither the dye nor hydrogen peroxide was employed.

The thus-obtained emulsions had a broad grain size distribution and were comprised of a mixture of various crystal forms such as a cube, an octahedron and a tetradecahedron.

Next, Emulsions D and E were subjected to gold-sulfur sensitization using soidum thiosulfate, chloroauric acid and potassium thiocyanate in a manner similar to that for Emulsion C to ensure that the three emulsions had the same degree of sensitivity.

To the so-obtained emulsions, the following agents were sequentially added and the resulting emulsions were each coated on cellulose acetate films and dried to obtain Samples 61, 62 and 63:

Yellow Coupler: α-Pivaloyl-α-(2,4-dioxo-5,5'-dimethyloxazolidine-3-yl)-2-chloro-5-[α-2,4-di-t-amylphenoxy-butanamido]acetanilide Stabilizer: 4-Hydroxy-6-methyl-1,3,3a,7-tetraazaindene Hardener: Sodium 2,4-dichloro-6-hydroxy-s-triazine Coating Aid: Sodium Dodecylbenzenesulfonate The samples were exposed to light through an optical wedge via a separation filter as used in Example 1, followed by development processing as shown below. The results are shown in Table 1. The relative sensitivity represents the relative value of the reciprocal of the exposure amount required for providing a density of +0.5 fog, with the value obtained by Sample 61 with respect to blue light taken as 100.

TABLE 1

| Sample No. | Fog | Relative Sensitivity to Blue Light | γ | Relative Sensitivity to Green Light |
|---|---|---|---|---|
| Sample 61 (Emulsion C) | 0.06 | 100 | 2.3 | 0 |
| Sample 62 (Emulsion D) | 0.06 | 100 | 2.3 | 0 |
| Sample 63 (Emulsion E) | 0.28 | 100 | 1.5 | 0 |

As is apparent from Table 1, Emulsions C and D of the present invention had no green sensitivity, and had harder contrast and low fog in the blue sensitive area as compared with Emulsion E.

The harder contrast is presumably accounted for by the fact that the grain size distribution has become narrower by using the dye in the formation of the grains. The lower fog is presumably explained by the fact that because of the uniform octahedron crystals, fog generation was reduced. In addition to this, the dye was deactivated by the deactivating agent and became incapable of preventing the subsequently added additives from exerting their effects. As a result, the emulsions had sufficient sensitivity in spite of the low fog.

| Processing | Time | Temperature |
|---|---|---|
| Color Development | 2 min 30 sec | 33° C. |
| Bleach-Fix | 1 min 30 sec | " |

-continued

| Processing | Time | Temperature |
|---|---|---|
| Washing | 2 min | " |
| Drying | | |

| Composition of the Color Developer | |
|---|---|
| Benzyl Alcohol | 15 ml |
| Sodium Sulfite | 5 g |
| Potassium Bromide | 0.5 g |
| Hydroxylamine Sulfate | 2.0 g |
| Sodium Carbonate | 30.0 g |
| Sodium Nitrilotriacetate | 2.0 g |
| 4-Amino-3-methyl-N—(β-methanesulfonamido)ethylaniline | 5.0 g |
| Water to make | 1,000 ml pH 10.1 |

| Composition of the Bleach-Fix Bath | |
|---|---|
| Ammonium Thiosulfate | 105 g |
| Sodium Sulfite | 2 g |
| Sodium-Iron EDTA | 40 g |
| Sodium Carbonate ($H_2O$) | 5 g |
| Water to make | 1,000 ml pH 7 |

EXAMPLE 3

Potassium 4-[5-chloro-2-{2-[1-(2-hydroxyethyl)-3-(2-pyridyl)-2-thiohydantoin-5-ylidene]vinylidene}-benzoxazoline-3-yl]butanesulfonate (D-5) (Emulsion F) or 3-carboxymethyl-5-[2-(3-ethylthiazolidine-2-ylidene)-vinylidene]rhodanine (D-7) (Emulsion G) or potassium 2-[5-(3-ethylbenzothiazoline-2-ylidene)rhodanine-3-yl]ethanesulfonate (D-3) (Emulsion H) was employed instead of the cyanine dye used in Example 2.

After grains were formed using these dyes, an aqueous hydrogen peroxide solution was added to oxidize and deactivate these dyes, followed by washing, desalting and gold-sulfur sensitization.

Emulsion F was comprised of grains having (110) and (100) faces;

Emulsion G was comprised of grains also having (110) and (100) faces; and

Emulsion H was comprised of grains having only a (111) face.

The dye used for grain formation in each of the above emulsions had been removed by the deactivating agent of the present invention, and as a result, the emulsions can be spectrally sensitized with respect to light having wavelengths different from the dyes used, according to the desired end use.

EXAMPLE 4

To 600 ml of 3.3% gelatin solution containing 1.2 mmol of potassium iodide, 7.6 mmol of potassium bromide and 4.7 mmol 3,6-dithia-1,8-octanediol which was kept at 53° C. with stirring were added 900 ml of 1.56M silver nitrate solution and a mixed solution of 1.81M potassium bromide and 0.023M potassium iodide by the double jet method over 40 min, while controlling the pAg level. Two minutes after the addition of the silver nitrate solution was started, 500 ml of 1 mM solution of 3-ethyl-2-[2-(1-ethyl-2-phenylindole-3-yl)vinyl]-6-nitrobenzothiazolium bromide (D-24) as a desensitizing dye was simultaneously added at a constant rate over 38 min. Then, 50 ml of 3% hydrogen peroxide solution and 300 mg of potassium tungstate were added and the resulting mixture was stirred at 50° C. for 20 min. After washing and desalting, the resulting emulsion was subjected to gold-sulfur sensitization with sodium thiosulfate, potassium chloroauric acid and potassium thiocyanate. The so-obtained silver iodobromide emulsion was highly monodispersed and comprised of tetradecahedron grains having a mean diameter of 0.58 μm. (Emulsion I).

Another silver iodobromide emulsion was prepared for comparative purposes in a manner similar to the above, except that neither hydrogen peroxide nor potassium tungstate was added. (Emulsion J).

Still another silver iodobromide emulsion was prepared for comparative purposes in a manner similar to Emulsion I, except that the addition of 3-ethyl-2-[2-(1-ethyl-2-phenylindole-3-yl)vinyl]-6-nitrobenzothiazolium bromide, hydrogen peroxide and potassium tungstate was omitted. This emulsion was comprised of tetradecahedron grains having a mean diameter of 0.60 μm, but the grains were more rounded as compared with the grains of Emulsions I and J and the emulsion was less monodispersed than the other two. (Emulsion K).

To each of Emulsions I, J and K were added the following agents and the resulting emulsion was coated on a cellulose acetate film and dried to obtain Samples 81, 82 and 83:

Sensitizing Dye: Sodium 3-[5-chloro-2-{2-[5-phenyl-3-(3-sulfonatopropyl)benzoxazoline-2-ylidenemethyl]-1-butenyl}-3-benzoxazolio]propanesulfonate (D-15)

Magenta Coupler: 1-(2,4,6-Trichlorophenyl)-3-[3-(2,4-di-t-amylphenoxyacetamido)benzamido]-5-pyrazolone Antifoggant: 1-Phenyl-5-mercaptotetrazole Stabilizer: 4-Hydroxy-6-methyl-1,3,3a,7-tetraazaindene Hardener: 1,3-Bisvinylsulfonylhydroxypropane Coating Aid: Sodium p-dodecylbenzenesulfonate, and sodium p-nonylphenoxypoly(ethyleneoxy)propanesulfonate Next, the so-obtained samples were exposed to light through a yellow filter, followed by color development as shown below to obtain the results shown in Table 2.

TABLE 2

| Sample No. | Fog | Relative Sensitivity | γ |
|---|---|---|---|
| Sample 81 (Emulsion I) | 0.06 | 100 | 2.1 |
| Sample 82 (Emulsion J) | 0.05 | 0 | — |
| Sample 83 (Emulsion K) | 0.07 | 105 | 1.5 |

As is apparent from Table 2, even in the case where grain formation is carried out using a desensitizing dye, the dye can be completely deactivated by an oxidizing agent of the present invention, and as a result, sufficient photographic performance can be obtained.

The development processing was performed at 38° C. in the following manner:

| | |
|---|---|
| 1. Color Development | 1 min 30 sec |
| 2. Bleach | 6 min 30 sec |
| 3. Washing | 3 min 15 sec |
| 4. Fixing | 6 min 30 sec |
| 5. Washing | 3 min 15 sec |
| 6. Stabilization | 3 min 15 sec |

The compositions of the processing solutions as used in the above processing are shown below:

| | |
|---|---|
| Color Developer: | |
| Sodium Nitrilotriacetate | 1.0 g |
| Sodium Sulfite | 4.0 g |
| Sodium Carbonate | 30.0 g |
| Potassium Bromide | 1.4 g |
| Hydroxylamine Sulfate | 2.4 g |
| 4-(N—Ethyl-N—β-hydroxyethylamino)-2-methylaniline Sulfate | 4.5 g |
| Water to make | 1 liter |
| Bleaching Solution: | |
| Ammonium Bromide | 160.0 g |
| Aqueous Ammonia (28%) | 25.0 cc |
| Sodium-Iron Ethylenediaminetetraacetic Acid | 130.0 g |
| Glacial Acetic Acid | 14.0 cc |
| Water to make | 1 liter |
| Fixer: | |
| Sodium Tetrapolyphosphate | 2.0 g |
| Sodium Sulfite | 4.0 g |
| Ammonium Thiosulfate (70%) | 175.0 cc |
| Sodium Bisulfite | 4.6 g |
| Water to make | 1 liter |
| Stabilizing Solution: | |
| Formalin | 8.0 cc |
| Water to make | 1 liter |

EFFECT OF INVENTION

In accordance with the present invention, silver halide photographic emulsions are prepared utilizing additives, such as dyes, sensitizers, auxiliary agents to be used upon gold sensitization, etc., and the additives are made to undergo deactivation at the time when their functions become needless and therethrough converted to those having no bad influences upon photographic characteristics of the emulsions prepared, or to those which can be removed from the emulsions with ease by a washing treatment. Therefore, the present invention can provide silver halide photographic emulsions excellent in photographic characteristics using various kinds of additives effectively.

Further, a photographic light-sensitive material which can produce an image of high quality, e.g., excellent in light fastness, can be obtained using the silver halide emulsions prepared in accordance with the present invention.

What is claimed is:

1. A process for preparing a silver halide photographic emulsion utilizing a dye of the kind which can be adsorbed by or react with silver halide grains within a period from the silver halide grain forming time to just before the emulsion coating step, which further comprises using an oxidizing agent which has the ability to act on said dye and which is selected from the group consisting of hydrogen peroxide, adducts of hydrogen peroxide, peroxy acid salts, organic peroxides, oxidizing gases, and halogen releasing oxidizing compounds, therethrough to lower or to extinguish its function of absorption or reaction at the time when the function of said dye becomes substantially needless.

2. A process for preparing a silver halide photographic emulsion as in claim 1, wherein said dye is a sensitizing dye.

3. A process for preparing a silver halide photographic emulsion as in claim 1, wherein said dye is a methine dye.

4. A process for preparing a silver halide photographic emulsion as in claim 1, wherein said dye is used in an amount of $10^{-8}$ to $10^{-2}$ mol per mol of silver halide.

5. A process for preparing a silver halide photographic emulsion as in claim 1, wherein an amount of said oxidizing agent used is 1/100 to 3,000 times that of the agent to be deactivated by mol.

6. A process for preparing a silver halide photographic emulsion as in claim 1, wherein an amount of the oxidizing agent used is 1/10 to 3,000 times that of said dye by mol.

7. A process for preparing a silver halide photographic emulsion as in claim 1, wherein the agent to be deactivated is used within a period from at the grain forming time to at the completion of chemical ripening.

8. A process for preparing a silver halide photographic emulsion as in claim 1, wherein the agent to be deactivated is used within a period from at the grain forming time to before the beginning of chemical ripening.

9. A process for preparing a silver halide photographic emulsion as in claim 1, wherein said dye is used within a period from at the grain forming time to before the beginning of washing step.

10. A process for preparing a silver halide photographic emulsion as in claim 1, wherein a reducing substance is used after using said oxidizing agent.

11. A process for preparing a silver halide photographic emulsion as in claim 1, wherein said oxidizing agent is used in the presence of a catalyst.

* * * * *